US005673239A

United States Patent [19]

Wong et al.

[11] Patent Number: 5,673,239

[45] Date of Patent: Sep. 30, 1997

[54] CLOCK MOVEMENT POWER TRANSMISSION UNION

[75] Inventors: Chen-Sheng Wong; Jung-Che Hsieh, both of Hsinchu; Shen-Yuan Chien, Ilang; Shern Lin, Hsindian, all of Taiwan

[73] Assignee: Industrial Technology Research Institute, Hsinchu, Taiwan

[21] Appl. No.: 594,551

[22] Filed: Jan. 31, 1996

[51] Int. Cl.[6] ..... G04B 19/04

[52] U.S. Cl. ..... 368/238; 368/80

[58] Field of Search ..... 368/234, 217, 368/238, 223, 80, 77

[56] References Cited

U.S. PATENT DOCUMENTS 517,594 4/1894 Smith ..... 368/238
3,106,817 10/1963 Ducommun ..... 368/238
5,103,434 4/1992 Sullivan ..... 368/238

*Primary Examiner*—Bernard Roskoski
*Attorney, Agent, or Firm*—W. Wayne Liauh

[57] ABSTRACT

An improved clock movement power transmission union is disclosed for saving space and providing flexibility of design options. It comprises: (a) a casing having main input and main output holes, wherein the main input and main output holes are disposed such that their fictitious axes intersect at a specific angle; (b) a main input shaft and a main output shaft received by the main input hole and the main output hole for rotating about their individual fictitious axes, respectively, so as to drive the hour, minute, and second hands independently. The main input shaft comprises a plurality of input shafts all rotatable about a common fictitious axis, and the main output shaft comprises an equal number of input shafts engageable with corresponding input shafts via a group of drive gear-driven gear combinations, respectively. With this design, the plurality of output shafts can receive rotational powers from the input shafts, respectively and independently of each other.

2 Claims, 3 Drawing Sheets

CLOCK MOVEMENT POWER TRANSMISSION UNION

BACKGROUND OF THE INVENTION

This present invention relates to a clock movement power transmission union, which changes the traditional way of clock movement for the hour, minute and second hands of the clock, by mounting the power transmission union in various angles to provide more design space for various clock products so that the resultant clocks are more practical for use, smaller in size, and cheaper in production cost, while with increased value.

Conventional clocks mount the drive union directly on the right rear side of the clocks, and a clock movement perpendicular to the clock panel is rotational for transmitting power to the hour, minute and second hands. Owing to this transmission type, the rooms for different types of design and shape are very limited.

In view of various defects found in the conventional clock power transmission union, the inventor therefore had dedicated himself to the research, persistent test improvement, and finally has successfully developed the present invention.

SUMMARY OF THE INVENTION

One object is to provide a clock movement power transmission union which may change the angle direction of the clock movement shaft to increase the possibility of shaping design of the clock products.

Another object is to provide a thin and space- saving clock movement power transmission union.

These and other objects and advantages of the present invention will become apparent to those skilled in art after considering the following detailed specification together with the accompanying drawings.

DETAILED DESCRIPTION OF PREFERRED EMBODIMENT

Figure 1:
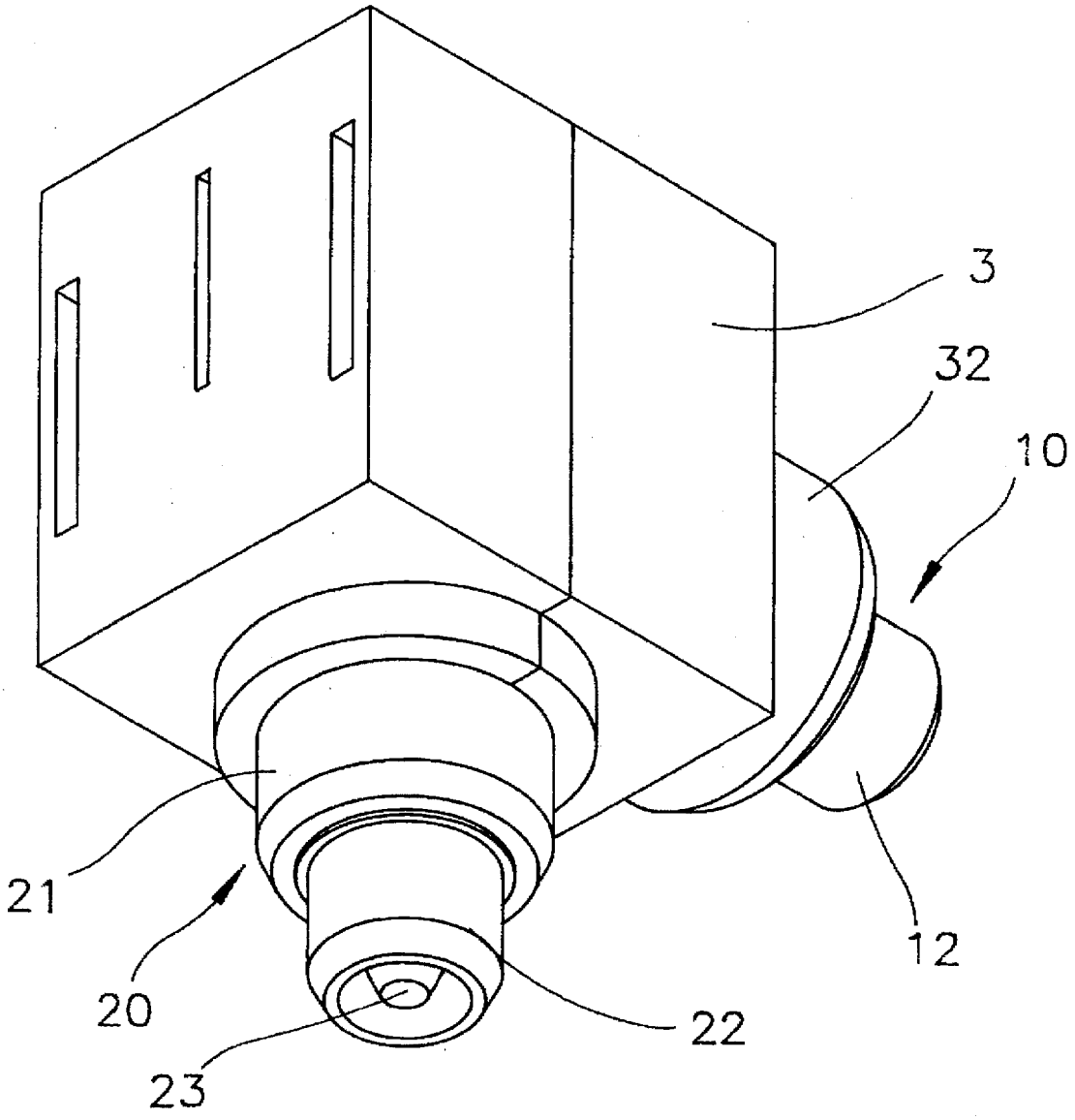
FIG. 1 is an elevational view of the outlook of the present invention after assembled.

Referring to the drawings, the power transmission union of the present invention is to use a clock movement as its base 6 and to use a drive device in the clock movement (not shown because the drive union of the clock movement is a prior art) in connection with a casing 3 by means of a connection tube 5, which drives the input shaft 10 at different rotational speeds about the first center shaft line 1, and further it drives the output shaft 20 to rotate about the second center shaft line 2 whereby hour, minute and second hands may have necessary rotational speeds respectively.

Figure 2:
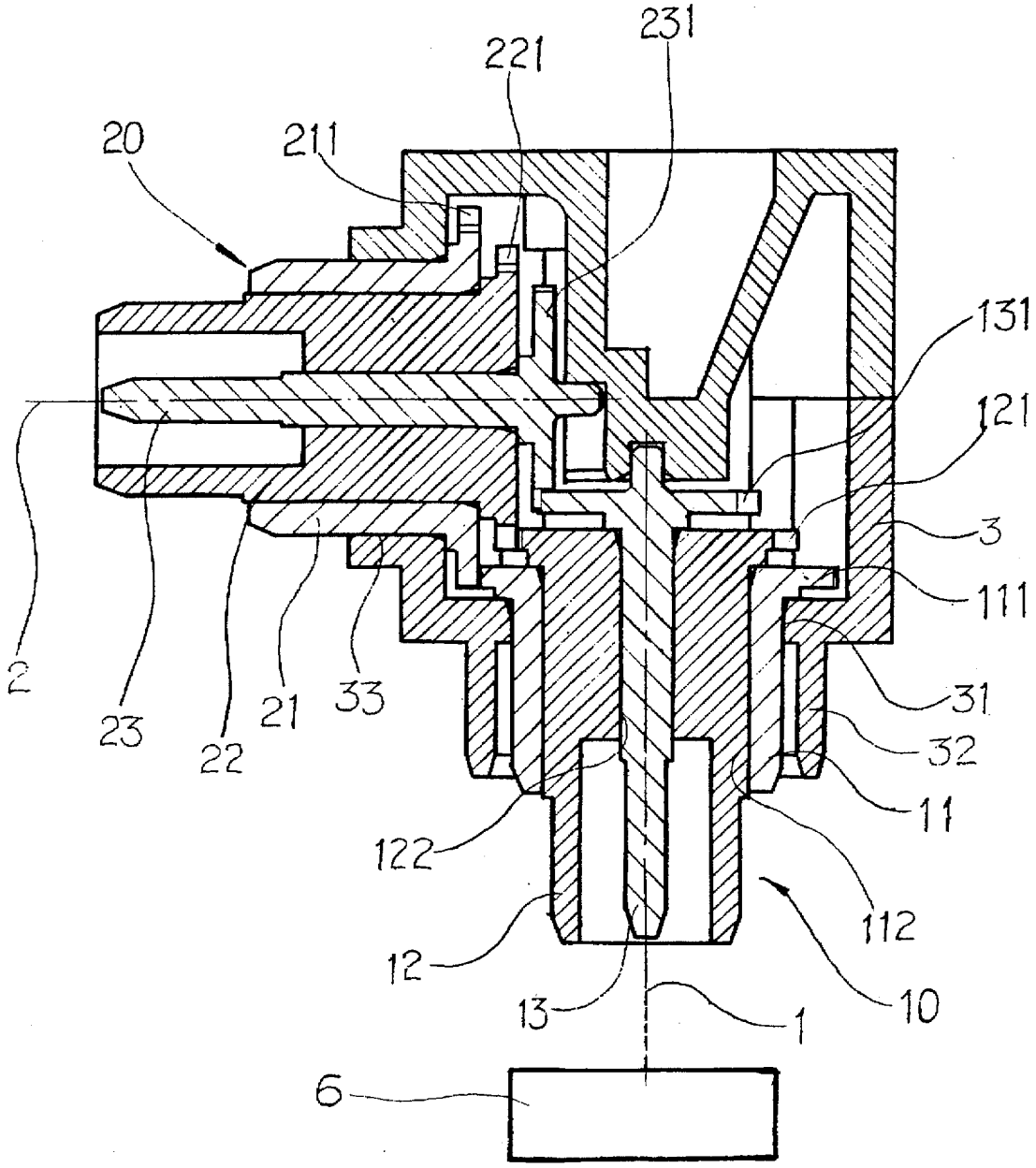
FIG. 2 is a sectional view of the present invention, showing the relationship of transmission members.

Referring to FIGS. 1 and 2, the middle portion of the casing 3 contains a receiving room for receiving the power transmission members of the main input shaft 10 and main output shaft 20 to rotate therein. The casing also holds the main input shaft 10 and main output shaft 20 such that the main input shaft 10 can be rotating securely around the first center shaft line 1 as the shaft center and the main output shaft 20 can be rotating securely around the second center shaft line 2 as the shaft center. The casing 3 also has a hole 31 on the central bottom portion thereof. The hole 31 is perpendicularly extending through the bottom of the casing 3 along the center of the first shaft center line 1, and the casing 3 also has a flange 32 outside the bottom portion thereof. The flange 32 is disposed at a predetermined distance from the perimeter of the hole 31.

The hole 33 is perpendicular to the first center shaft line 1 (appearing various angles) along the shaft center of the second center shaft line 2 whereby the hole 33 is mounted perpendicular to the hole 31.

The hole 31 is provided for receiving the main input shaft 10 and the main input shaft 10 further includes an input shaft 11, and the input shaft 11 can turn within the inside diameter of the hole 31 about the shall center of the first center shaft line 1 and in connection with a specific drive shaft (not shown because it is a prior art) on the drive union of the clock movement 6. The input shaft 11 has a drive wheel 111 on the top end thereof. The drive wheel 111 is a circular gear and is received in the receiving room of the casing 3. The input shaft 11 has a hole 112 in the center lower portion thereof. The hole 112 is also symmetrical about the first center shaft line 1 as the shaft center and the hole 112 has a input shaft 12 received therein, whereby the input shaft 12 also may turn around the first center shaft line 1 as the shaft center.

The input shaft 12 will turn simultaneously with the clock movement 6 (not shown because it is a prior art). The top end of the input shaft 12 has a drive wheel 121 provided thereon which is smaller than the drive wheel 111 putting on the drive wheel 111 of the input shaft 11. Likewise the input shaft 12 has a hole 122 provided in the bottom center thereof. The hole 122 is symmetrical about the first center shaft line 1 as the shaft center for receiving a input shaft 13 whereby the input shaft 13 will also turn simultaneously with the clock movement 6 in the hole 122.

The input shaft 13 has a drive wheel 131 near the outside diameter of top end. The drive wheel 131 is slightly smaller than the drive wheel 121 and is mounted on the drive wheel whereby the input shaft 11, input shaft 12 and input shaft 13 of the input shaft 10 may rotate around the first center shaft line 1 as the shaft center. These cause the drive wheels 111, 121, 131, to rotate independently of each other at respective speeds without any interference.

The hole 33 is provided to receive the main output shaft 20. The output shaft 20 and the input shaft 10 are rotating at an angle (FIG. 2, perpendicular manner) with respect to each other. The same angle is provided as the mounting angle of the input shafts 11, 12, 13 of the main input shaft 10, with respect to the output shaft 21, output shaft 22, output shaft 23, of the main output shaft 20. The output shafts 21, 22, and 23 are provided with driven wheel 211, driven wheel 221 and driven wheel 231, respectively whereby the driven wheel 211, driven wheel 221 and driven wheel 231 are engaged with the drive wheel 111, drive wheel 121, and drive wheel 131 of the input shaft 10, respectively such that they can rotate independently without mutual interference.

Figure 3:
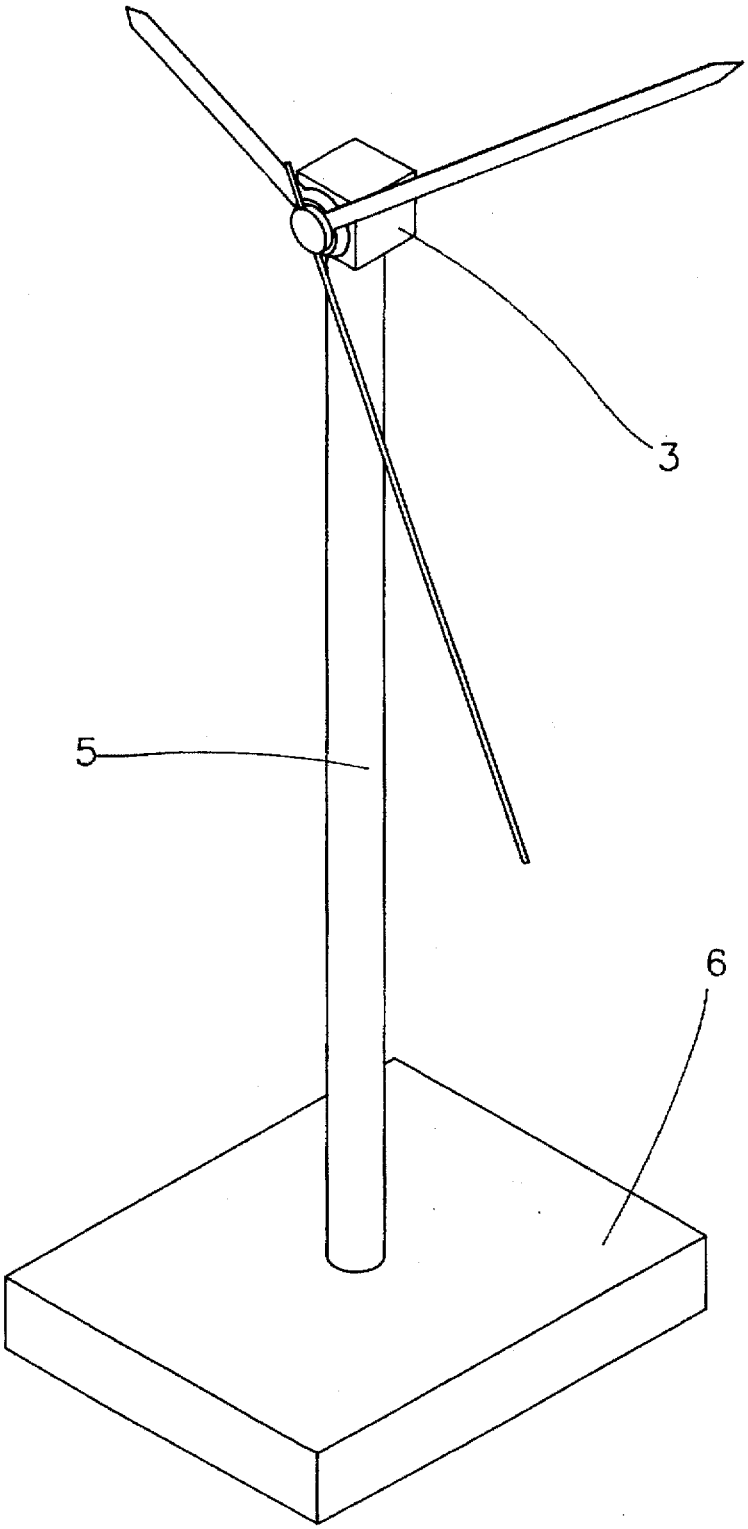
FIG. 3 is an embodiment showing the application of the present invention with the clock movement (before outlook design).

Because the input shaft 11, input shaft 12 and input shaft 13 of the input shaft 10 are each respectively connected with the drive shafts of the clock movement 6 whereby the drive wheel 111, drive wheel 121 and drive wheel 131 can transmit power to the driven wheel 211, driven wheel 221 and driven wheel 231 respectively and independently. Therefore, the output shaft 21, output shaft 22 and output shaft 23 may connect with the hour, minute, and second hands on the clock panel (FIGS. 2,3) according to the speed under the control of the clock movement whereby time indication of the clock movement 6 may be perpendicularly transmitted to the clock panel for indicating time by means of the clock movement transmission union of the present invention.

The main input shaft and main output shaft may be disposed at any angular transmission and the transmission gear may provide gearing at different angles and the clock movement shaft may also change the angle whereby the design of the clock outlook will not be limited to the flat pattern design and may satisfy the desire of consumers in various age groups by means of a variety of any solid shapes.

The present invention is to mount the drive union independently so as to break through the restriction of dimensions when the clock is required for the design of small and thin outlook.

We claim:

1. A clock movement power transmission union for driving the hour, minute, second hands and other movable members of a clock, comprising:

a casing having main input and main output holes said main input and main output holes are disposed such that their fictitious axes intersect at a specific angle; and main input shaft and main output shaft received by said main input hole and said main output hole for rotating about their fictitious axes respectively so as to drive said hour minute and second 121 hands independently:

wherein said main input shaft comprises;

first, second, and third input shafts all rotatable about a common fictitious axis, said first input shaft being received by said main input hole, said second input shaft being received by a first input hole provided inside said first input shaft, and said third input shaft being received by a second input hole provided inside said second input shaft; said first, second, and third input shafts being able to receive power from clock movement independently;

first, second, and third drive gears provided near top ends of said first, second, and third input shafts, respectively;

and said main output shaft comprises:

first, second, and third output shafts all rotatable about a common fictitious axis, said first output shaft being received by said main output hole, said second output shaft being received by a first output hole provided inside said first output shaft, and said third output shaft being received by a second output hole provided inside said second output shaft;

first, second, and third driven gears provided near inner ends of said first, second, and third output shafts, respectively, engageable with said first, second, and third drive gears, respectively, so as to cause said first, second, and third output shafts to receive rotational power from said first, second, and third input shafts, respectively and independently of each other.

2. The clock movement power transmission union according to claim 1, wherein said main input hole and said main output hole are disposed such that their fictitious axes are substantially perpendicular to each other.

* * * * *